US011532295B1

(12) United States Patent
Monier et al.

(10) Patent No.: US 11,532,295 B1
(45) Date of Patent: Dec. 20, 2022

(54) CEILING TILE WITH BAFFLE AND STABILIZING MEMBER

(71) Applicant: FACT Design, LLC, Sweetwater, TN (US)

(72) Inventors: Daniel Monier, Atlanta, GA (US); Troy S. Jones, Sweetwater, TN (US)

(73) Assignee: FACT Design, LLC, Sweetwater, TN (US)

( * ) Notice: Subject to any disclaimer, the term of this patent is extended or adjusted under 35 U.S.C. 154(b) by 0 days.

(21) Appl. No.: 17/691,496

(22) Filed: Mar. 10, 2022

(51) Int. Cl.
*G10K 11/162* (2006.01)
*E04B 9/04* (2006.01)
*E04B 9/00* (2006.01)

(52) U.S. Cl.
CPC ..... *G10K 11/162* (2013.01); *E04B 9/001* (2013.01); *E04B 9/0414* (2013.01)

(58) Field of Classification Search
CPC ..... G10K 11/162; E04B 9/001; E04B 9/0414
USPC ..... 181/284
See application file for complete search history.

(56) References Cited

U.S. PATENT DOCUMENTS

| | | | |
|---|---|---|---|
| 1,845,080 | A | 2/1932 | Eyring et al. |
| 2,882,990 | A | 4/1959 | Mustoe |
| 3,321,877 | A | 5/1967 | Alexieff |
| 3,343,309 | A | 9/1967 | Norman et al. |
| 3,404,498 | A | 10/1968 | Espinoza |
| 3,466,830 | A | 9/1969 | Smith |
| 3,548,735 | A | 12/1970 | Sweeney et al. |
| 3,685,235 | A | 8/1972 | Lang |
| 3,835,614 | A | 9/1974 | Downing |
| 3,969,870 | A | 7/1976 | Deaton |
| 4,330,046 | A | 5/1982 | Lerner et al. |
| 4,665,674 | A | 5/1987 | Brugman |
| 4,672,780 | A | 6/1987 | Lockwood |
| 4,776,139 | A | 10/1988 | Lockwood |
| D373,831 | S | 9/1996 | Lechleiter et al. |
| 6,467,209 | B1 | 10/2002 | Vickers |

(Continued)

FOREIGN PATENT DOCUMENTS

| | | | |
|---|---|---|---|
| FR | 3088352 | A1 | 5/2020 |
| WO | 2020095163 | A1 | 5/2020 |

OTHER PUBLICATIONS

Sullivan, C. C., & Horwitz-Bennett, B. (Feb. 2013). "New Trends in Ceiling Designs and Materials." Ceiling Systems AIA Continuing Education.

(Continued)

*Primary Examiner* — Forrest M Phillips
(74) *Attorney, Agent, or Firm* — United IP Counselors, LLC

(57) ABSTRACT

A baffle tile has a tile and a baffle. The tile is sized and shaped to be placed in a drop ceiling grid, and has a slot through its thickness. The body of the baffle is inserted into the slot in the tile so that the baffle hangs down from the tile. A pair of folding flaps are defined in an upper extent of the baffle by respective fold lines. The folding flaps are folded outwardly and down, such that they abut the upper surface of the tile. Folded down, the folding flaps define a locking slot. A locking member with features complementary to the locking slot is inserted into the locking slot to lock the folding flaps into position. The baffle itself may have additional fold lines so that it can be folded into its usable configuration from a flat sheet of material, without adhesives or fasteners.

21 Claims, 14 Drawing Sheets

(56) References Cited

U.S. PATENT DOCUMENTS

| | | | | |
|---|---|---|---|---|
| 6,622,579 | B1 | 9/2003 | Muth et al. | |
| 8,327,591 | B2 | 12/2012 | Wilkinson, Jr. et al. | |
| 8,733,053 | B2 | 5/2014 | Kabatsi et al. | |
| 8,782,987 | B2 | 7/2014 | Kabatsi et al. | |
| 9,038,326 | B2 | 5/2015 | Bergman et al. | |
| 9,487,952 | B2 | 11/2016 | Nilsson et al. | |
| 9,765,519 | B2 | 9/2017 | Bergman | |
| 10,006,619 | B1 | 6/2018 | Niemiec et al. | |
| 10,359,163 | B1 * | 7/2019 | Hettwer | F21S 8/04 |
| 10,508,444 | B2 | 12/2019 | Gillette et al. | |
| 10,584,488 | B2 * | 3/2020 | Gillette | G10K 11/168 |
| 10,662,647 | B2 * | 5/2020 | Kilian | E04B 9/225 |
| 10,928,020 | B1 * | 2/2021 | Ahmadi | F21V 21/048 |
| 10,975,568 | B1 | 4/2021 | Monier et al. | |
| 11,174,635 | B1 | 11/2021 | Monier et al. | |
| 2006/0016145 | A1 | 1/2006 | Lonneman | |
| 2011/0146183 | A1 | 6/2011 | Wilkens et al. | |
| 2014/0157689 | A1 * | 6/2014 | Bergman | E04B 9/001 52/745.13 |
| 2015/0068135 | A1 * | 3/2015 | Waters | E04B 9/006 52/39 |
| 2018/0180052 | A1 | 6/2018 | Niemiec et al. | |
| 2018/0245344 | A1 | 8/2018 | Venjen-Jensen et al. | |
| 2018/0363295 | A1 | 12/2018 | Gillette | |
| 2019/0113219 | A1 | 4/2019 | Niemiec et al. | |
| 2020/0002942 | A1 * | 1/2020 | Headley | E04B 9/001 |

OTHER PUBLICATIONS

U.S. Appl. No. 17/181,340, filed Feb. 22, 2021.

* cited by examiner

CEILING TILE WITH BAFFLE AND STABILIZING MEMBER

TECHNICAL FIELD

The invention relates generally to ceiling tiles, and more specifically to ceiling tiles with insertable baffles.

BACKGROUND

Grid-based drop ceilings are ubiquitous in commercial and some residential spaces. These types of ceilings use tiles placed in a suspended grid to conceal mechanical structure in the ceiling, such as ductwork, as well as to dampen noise in the space below.

U.S. Pat. Nos. 10,975,568 and 11,174,635 disclose ceiling tiles for grid-based drop ceilings. The ceiling tiles of these patents have hanging baffles that serve to improve noise reduction while retaining the useful features of grid-based tiles. Many of the tiles disclosed by these patents are made in a single piece—a sheet of tile material folds from a flat configuration into a three-dimensional configuration that includes a tile portion that rests in the grid as well as the baffle. However, U.S. Pat. No. 10,975,568 does disclose an embodiment of a baffle-tile in which the baffle is a separate piece that inserts into a slot in the main body of the tile. In this separate-baffle tile, the baffle has a thickened top portion that prevents it from falling through the tile.

While the separate-baffle tile of U.S. Pat. No. 10,975,568 is useful, its thickened top portion may pose issues at multiple points in the product lifecycle. During manufacture, the thickened top portion may require the use of fasteners or adhesive, which complicates the manufacturing process. When the tile is disposed of at the end of its lifecycle, the presence of adhesives or fasteners may make it difficult to recycle the material.

BRIEF SUMMARY

One aspect of the invention relates to a ceiling tile. The ceiling tile includes a tile, a baffle, and a locking member. The tile has a slot through its thickness. The baffle has a body sized and adapted to insert through the slot in the tile. A pair of flaps are defined in the baffle by fold lines and are adapted to fold outwardly, away from the body of the baffle. The flaps also have a locking slot that is defined in or by them. The locking member is complementary to the slot and can be inserted into it to lock the pair of flaps into place.

In one embodiment according to this aspect of the invention, the baffle may be made of a single sheet of material, in which case, the body may comprise two thicknesses of material folded against one another about a central fold line in the sheet of material. In many embodiments, the tile, the baffle, and the locking member may be made of the same type and thickness of material, such as a polyethylene terephthalate felt. With this arrangement, all of the parts can be cut from sheets of tile material.

In embodiments according to these aspects of the invention, a tile may have several slots for baffles, so that several baffles can be installed in a single tile. In these embodiments, the slots for the baffles may be arranged in various ways: offset symmetrically from the centerline of the tile, horizontally staggered, or positioned at angles to one another.

In other embodiments, the body of the baffle may fold such that it has open sides. For example, the body of the baffle may fold to take the shape of a rectangular prism, a trapezoidal prism, etc. In these cases, instead of a single locking member, a pair of locking members may be used. Each of these locking members may have a first portion that engages the slot as described above and a second portion sized and adapted to fold down to close one of the open sides of the body of the baffle. A predefined fold line allows the second portion of the locking member to fold relative to the first portion.

Another aspect of the invention relates to a method of assembling a ceiling tile with a baffle. The method comprises inserting the body of a baffle through a slot in the tile. The baffle includes a pair of flaps, and once the baffle is inserted through the slot, the pair of flaps are folded down, against the upper surface of the tile. The pair of flaps define a slot, and when they are folded down, a locking member is inserted into the slot to lock the pair of flaps into place. The locking member may have alignment features, and the locking slot into which it inserts may have complementary features.

Other aspects, features, and advantages of the invention will be set forth in the following description.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
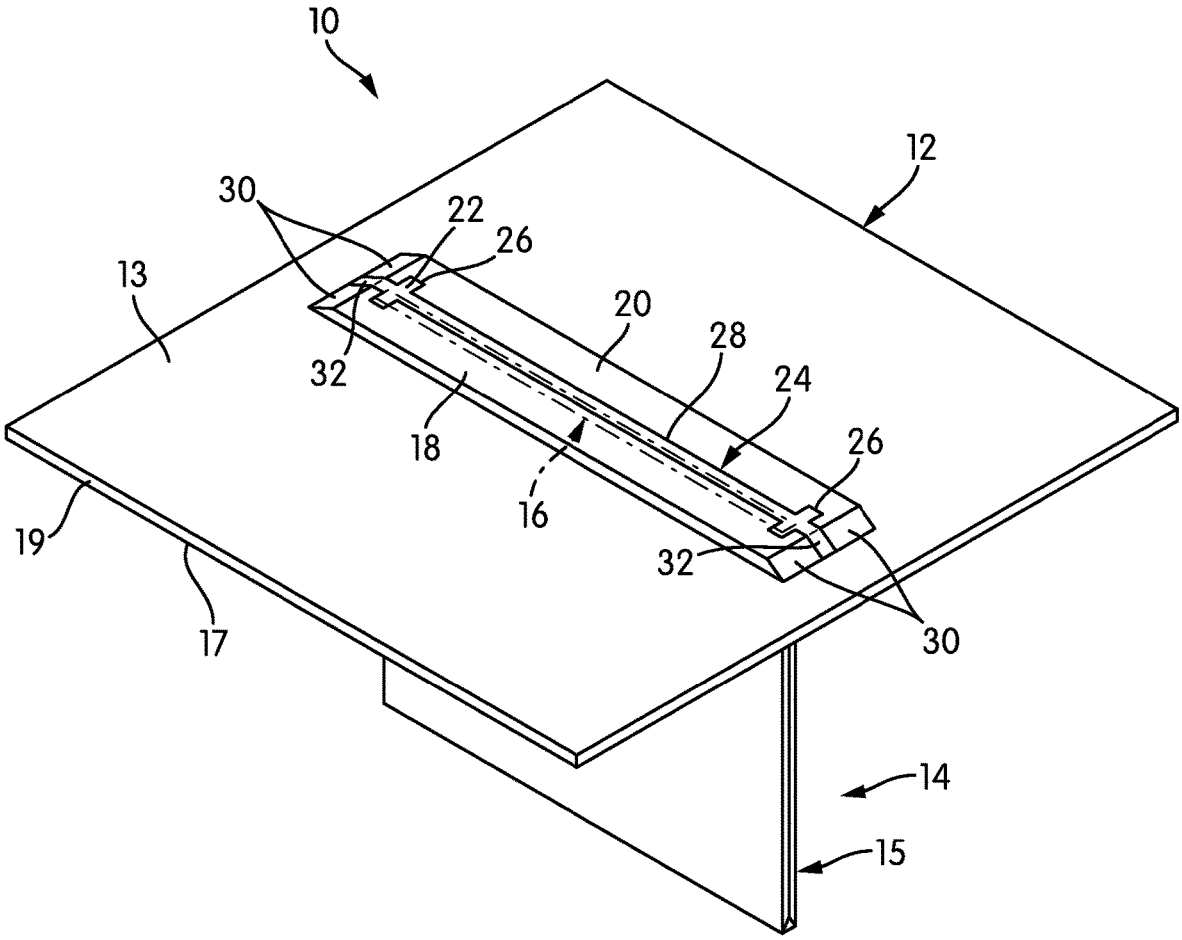
FIG. 1 is a perspective view of a baffle tile according to one embodiment of the invention.

FIG. 1 is a perspective view of a baffle tile, generally indicated at 10, according to one embodiment of the invention. The baffle tile 10 has two main parts: a tile 12 and a baffle 14. The tile 12 is typically made of a sheet of tile material, and has an upper face 13 and a lower face 17, between which the thickness 19 of the tile 12 is defined. The baffle 14 extends downward from the tile 12 and may provide additional dissipation of noise or other such benefits. As will be described below in more detail, the tile 12 and the baffle 14 in this embodiment are separate parts. The baffle 14 inserts into a slot 16 in the tile 12. The upper edge of the baffle 14 includes foldable flaps 18, 20 that are folded down against the tile 12 and are secured with a locking member 22. This arrangement allows the baffle 14 to be construed as a single piece of material and folded into the secure, stable position shown in FIG. 1.

More specifically, as can be seen in FIG. 1, the foldable flaps 18, 20 have a greater length and width than the slot 16, and so prevent the baffle 14 from falling through the slot 16. The surface area of the two foldable flaps 18, 20 is large enough to support and distribute the weight of the baffle 14 while supported by and bearing on the upper surface of the tile 12.

Toward their proximal edges, where they meet, the two foldable flaps 18, 20 are shaped and cut in such a way that they define a slot 24 with specific features, including a transverse extent or cross 26 at each end, as well as an elongate, straight section 28 between the ends. The locking member 22 has features that are complementary to those of the slot 24. The precise features of the locking member 22 and the slot 24 may vary from embodiment to embodiment, and are not critical so long as they are complementary such that the insertion of the locking member 22 into the slot 24 forces the foldable flaps 18, 20 into the position shown in FIG. 1 and keeps them there.

The flaps 18, 20 are longer than they are wide. The long ends 30 of the flaps 18, 20 are beveled, as are the long ends 32 of the locking member 22.

Figure 2:
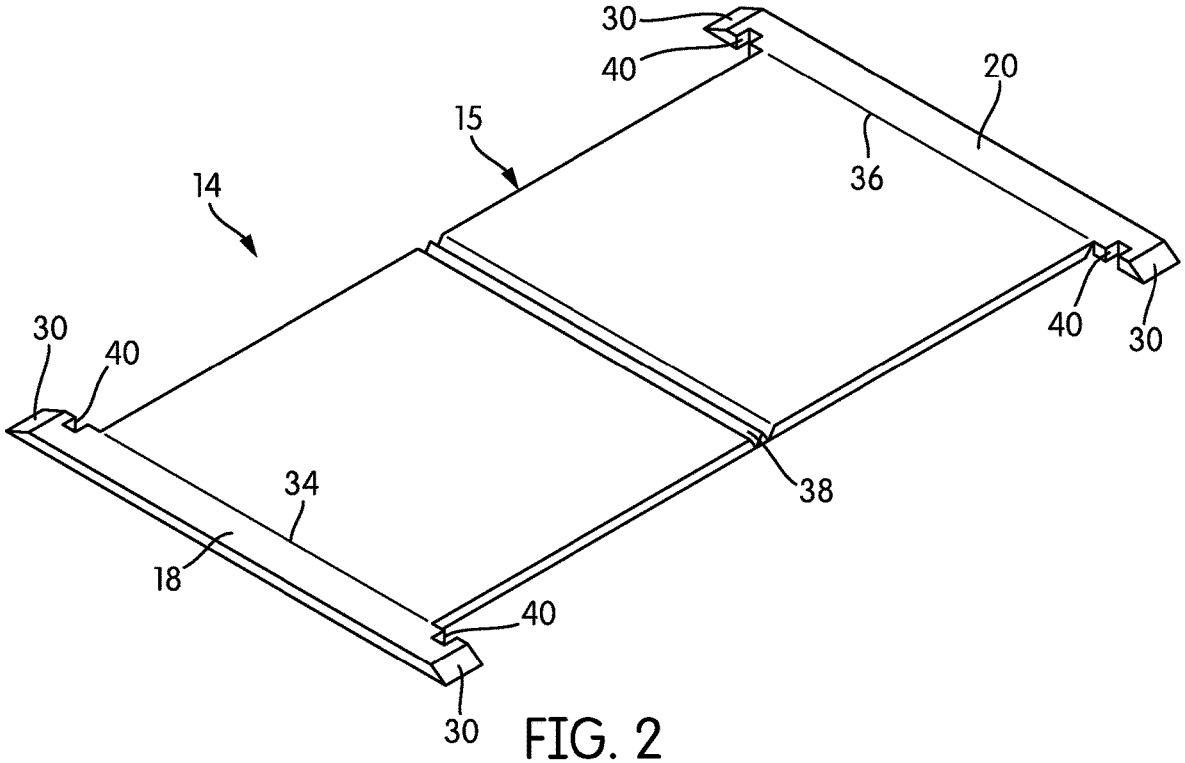
FIG. 2 is a perspective view of a baffle, shown in isolation and in its unfolded configuration.

FIGS. 2-6 are perspective views illustrating the baffle 14, the tile 12, and the process of assembling the two. FIG. 2 is a perspective view of the baffle 14 in isolation, showing its unfolded configuration. The unfolded configuration of the baffle 14 is generally rectilinear in shape. The overall size of the baffle 14 will vary with the size of the tile 12 and the size of the slot 16. In this embodiment, the baffle 14 is sized such that it can be cut from, e.g., a standard 2-foot by 4-foot sheet of tile material.

As shown in FIG. 2, the baffle 14 has the two foldable flaps 18, 20, which are separated from the body of the baffle 14 by individual fold lines 34, 36. The term "fold lines" is a general one that, for purposes of this description, means any sort of modification to the tile that allows it to fold along the defined line, including cuts (such as V-cuts) and scores. In some embodiments, it may be necessary or desirable to add a reinforcing member that acts as a hinge or a hinge per se, and the term "fold lines" should be read broadly enough to encompass hinges and reinforced hinging areas that serve as hinges. The fold lines 34, 36 may be defined, e.g., by V-cuts in the material. In the illustrated embodiment, the body of the baffle 14 comprises a folded double-thickness of tile material. In the longitudinal center of the baffle 14, a central fold line 38 is, in this case, defined by two adjacent V-cuts in the material.

Figure 3:
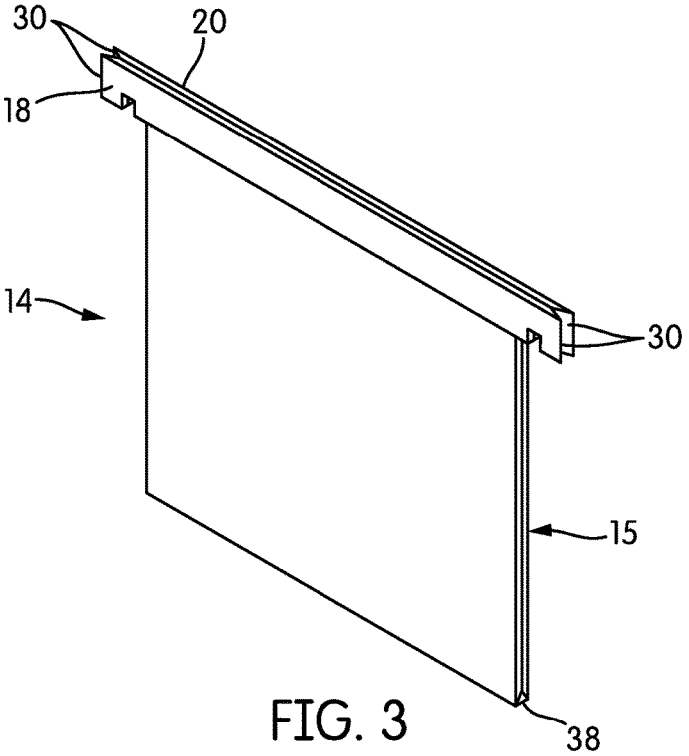
FIG. 3 is a perspective view of the baffle of FIG. 2 in a folded configuration.

FIG. 3 illustrates the baffle 14 when folded along the central fold line 38. As shown in FIGS. 2 and 3, each of the folding flaps 18, 20 has a rectangular cut 40 extending inward from each inner, outboard edge. These cuts form the transverse portions 26 of the slot 28 when the folding flaps 18, 20 are in the position of FIG. 1. The beveled edges 30 are also shown in FIGS. 2 and 3.

The arrangement shown in FIGS. 2-3 allows the baffle 14 to be made from a standard sheet of tile material but have a body 15, the portion of the baffle 14 that extends down through the slot 16, that is twice the thickness of a standard sheet of tile material. For example, a standard sheet of tile material may have a thickness of 9 mm (0.35 in). With the folding shown in FIGS. 3-4, the folded body 15 of the baffle 14 may be 18 mm (0.70 in).

In most modern installations, ceiling tiles are made of a polyethylene terephthalate (PET) felt, typically with at least some recycled content. The tile 12 and the baffle 14 may be made with PET felt, or with any other material that is commonly used to make ceiling tiles. References to "tile material" in this description should be construed to refer to any material of which a ceiling tile may be made, although many embodiments will be made of PET felt.

Of course, the tile 12 and baffle 14 need not be made of any standard ceiling tile material, although it is helpful if they are light enough to be properly supported by a drop-ceiling grid. Because the tile 12 and baffle 14 are separate, it is also possible for the tile 12 and the baffle 14 to be made of different materials from one another. For example, the baffle 14 could be made of a material that is more dissipative of acoustical energy, more dissipative of acoustical energy in particular frequency ranges, etc. Beyond functional reasons for making the tile 12 and the baffle 14 of different materials, the baffle 14 may also be made of a different material for architectural or aesthetic reasons. For example, if the baffle 14 and tile 12 are made of the same type of material, the baffle 14 may be made of a different color of material than the tile 12.

Additionally, although the configuration of the baffle 14 shown in FIGS. 2-3 is convenient because it can be made easily by cutting existing flat sheets of tile material, there is no requirement that a baffle fold in embodiments of the invention. In some embodiments, the baffle may comprise a thick section of material with folding flaps. In these embodiments, the fold lines that define the folding flaps may be different from the fold lines 34, 36 of the illustrated embodiment.

Figure 4:
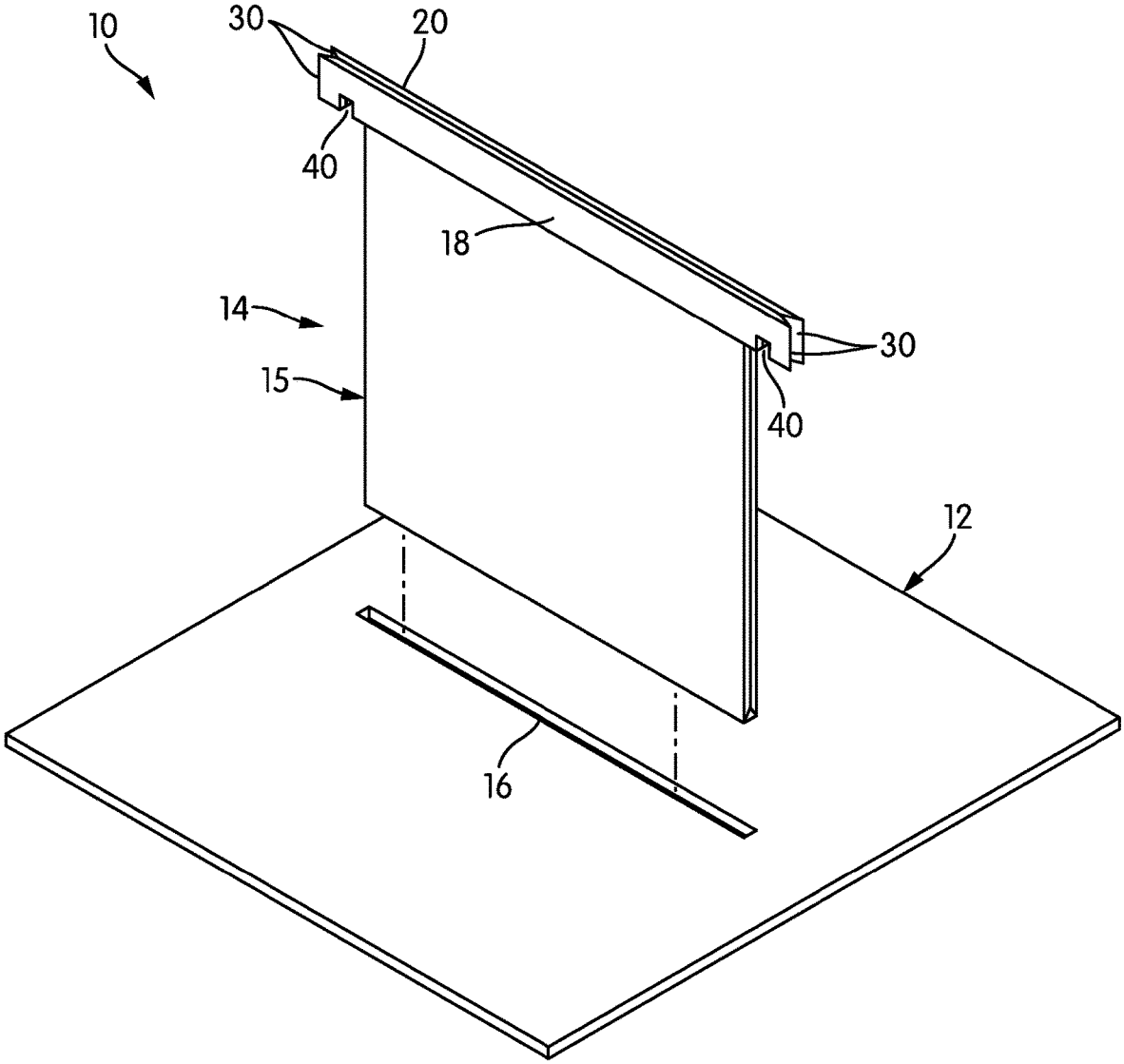
FIG. 4 is an exploded perspective view illustrating the insertion of the baffle into the tile.

FIG. 4 is an exploded perspective view illustrating the insertion of the baffle 14 into the slot 16 in the tile 12. In the illustrated embodiment, the tile 12 is a square tile, e.g., a two-foot by two-foot tile. However, one advantage of the separate baffle 14 and tile 12 is that the tile 12 may be any type of tile, including a rectangular tile, such as a standard two-foot by four-foot tile. Therefore, the slot 16 in the tile 12 may be longer or shorter than shown and it may be positioned differently than in FIG. 4, particularly if the proportions of the tile 12 are different. For example, the slot 16 may extend along the longitudinal axis of the tile 12, along the transverse axis of the tile 12, diagonally across the tile 12, or in some other position or orientation. As shown in FIG. 4, the slot 16 is closed on all sides, i.e., enclosed by the tile material around it.

Figure 5:
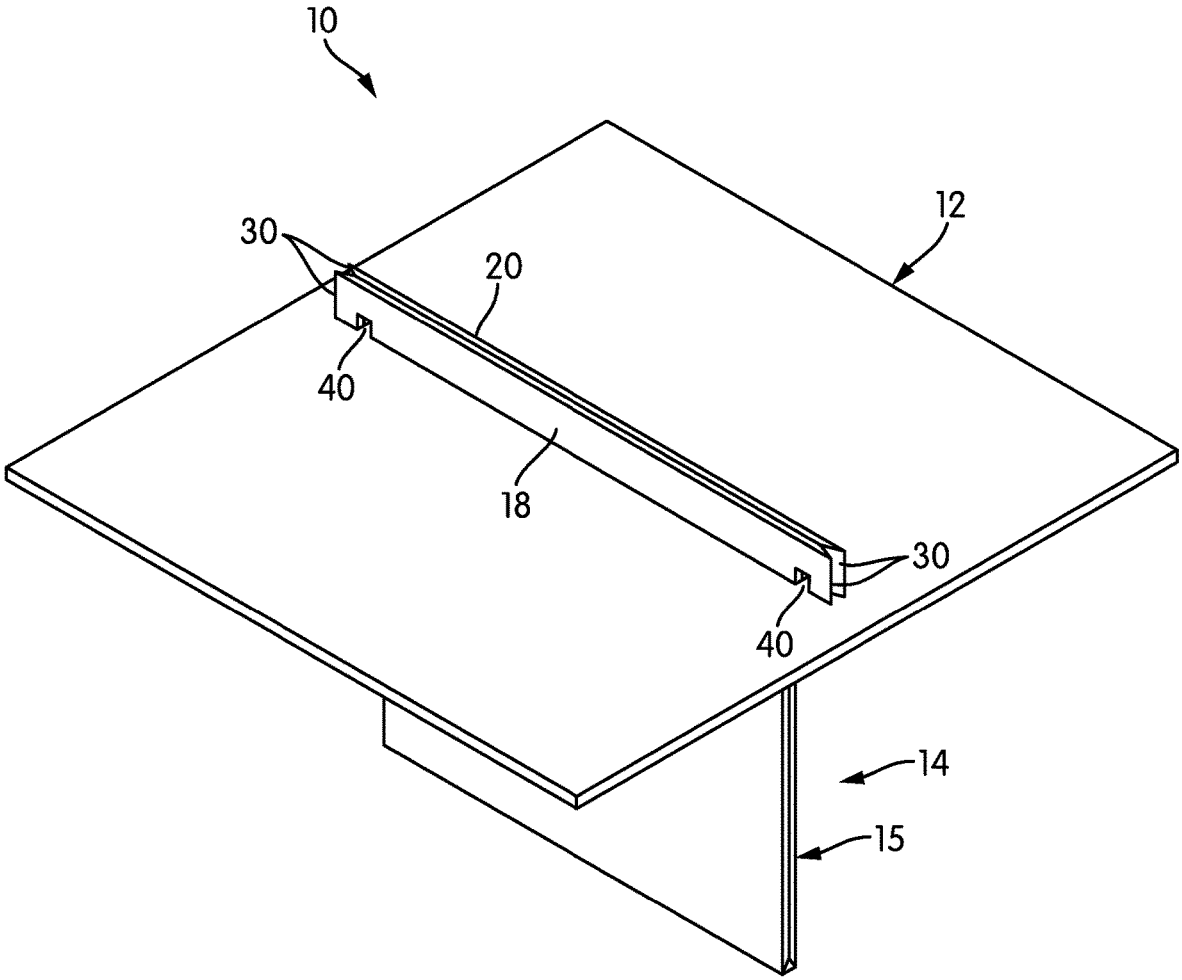
FIG. 5 is a perspective view illustrating the baffle inserted into the tile.

In this embodiment, the baffle 14 is driven straight into the slot 16. The slot 16 typically has a size and shape complementary to the size and shape of the folded body 15 of the baffle 14. In some embodiments, the slot 16 may have a width just wider than the width of the body 15 of the baffle 14, such that when the baffle 14 is inserted into the slot 16, there is a tight, frictional fit that helps to retain the baffle 14 in the slot 16. FIG. 5 illustrates the position of the baffle 14 with its body 15 inserted into the slot 16.

Figure 6:
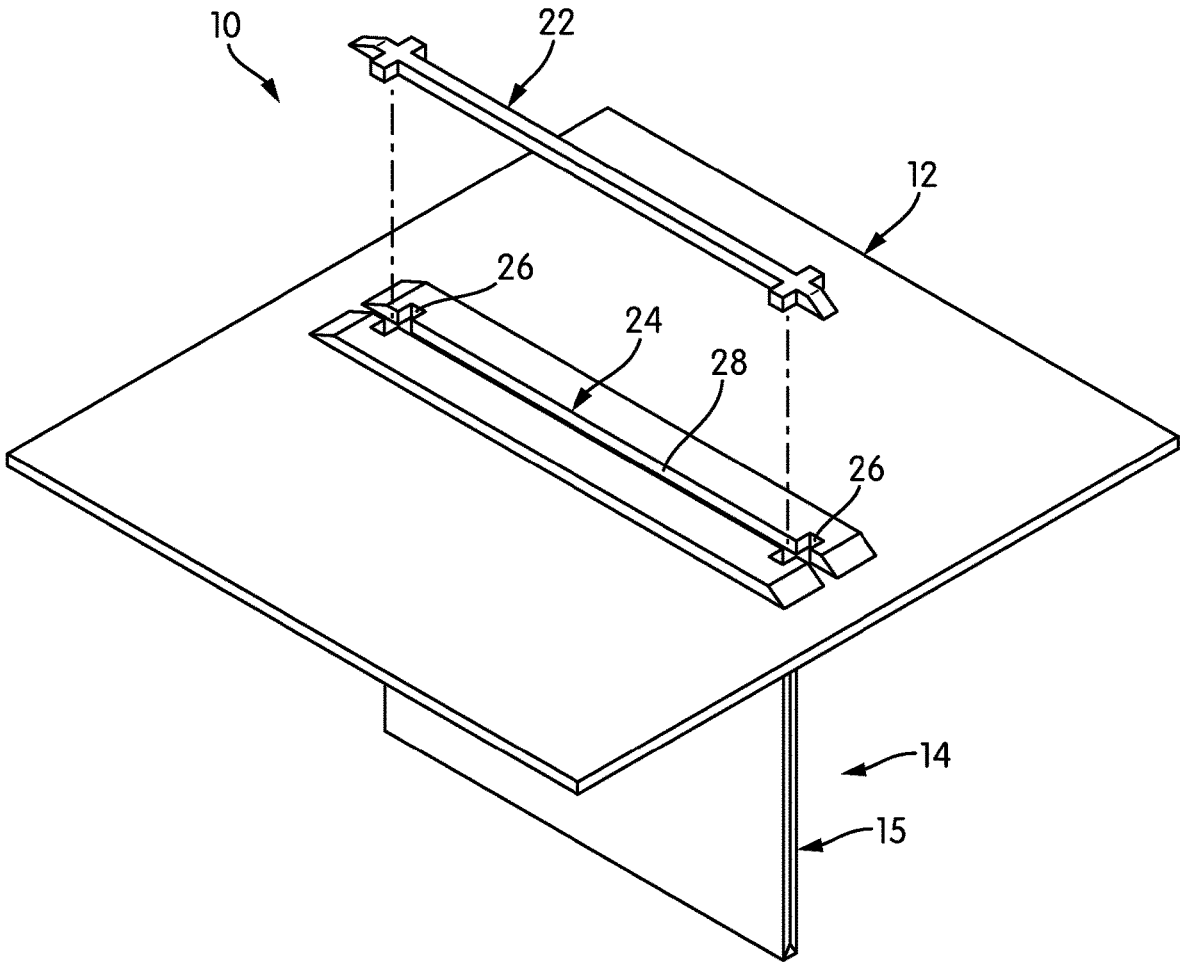
FIG. 6 is an exploded perspective view illustrating the insertion of a locking member into the down-folded flaps of the baffle.

FIG. 6 is an exploded perspective view illustrating the final steps in assembling the baffle tile 10. Once the baffle 14 is inserted into the tile 12, the foldable flaps 18, 20 are folded down against the upper surface of the tile 12. The direction of folding of the flaps 18, 20 is outward and away from the centerline of the body 15. This creates and exposes the slot 16. The locking member 22 is then inserted into the slot 16, in this case, by pressing down from above.

As was described briefly above, the locking member 22 inserts into the slot 24. The slot 24 is defined by the shape of the foldable flaps 18, 20 and by specific features 40 cut into the foldable flaps 18, 20. Essentially, the presence of the locking member 22 forces the flaps 18, 20 to remain apart and folded down against the upper surface of the tile 12.

In the illustrated embodiment, the locking member 22 has a long, central portion 42 with a cross-piece 44 at each end, corresponding to the elongate, straight section 28 and the transverse extents or crosses 26 of the slot 24 into which the locking member 22 inserts. In this embodiment, the locking member 22 is made of tile material, and would typically be made of the same material, and the same thickness of material, as the tile 12 and baffle 14, although other materials could be used. Thus, when pressed into the slot 24 defined by the two flaps 18, 20, the locking member 22 lies flat, even with the thickness of the flaps 18, 20.

Normally, once installed, ceiling tiles like the baffle tile 10 are not disassembled. However, if disassembly is a concern, the locking member 22 could be made of thicker material, so that it is easier to grab and pull out of the slot 24.

During the insertion of the locking member 22, the cross-pieces 44 of the locking member 22 and the corresponding transverse extents or crosses 26 of the slot 24 are, in part, alignment features—they may help an installer to align the locking member 22 with the slot 24 for proper installation. However, as those of skill in the art will note, cross-pieces 44 are not necessary in all embodiments. In other embodiments, for example, an elongate, rectangular strip of tile material could serve as a locking member, and a tight, frictional fit between that simple locking member and its slot could prevent it from shifting once placed. Of course, other shapes for the locking member 22 are also possible and may be used. In other embodiments, the slot for the locking member may simply be defined between the respective foldable flaps 18, 20, rather than being partially cut into the foldable flaps 18, 20.

As those of skill in the art will note, the arrangement of the baffle tile 10, and particularly the configuration of the baffle 14, the locking member 22, and its complementary slot, make it possible to assemble the baffle tile 10 without the use of fasteners or adhesives. Rather, the assembly of the baffle tile 10 involves a change in the configuration and position of the foldable flaps 18, 20 of the baffle 14. With the weight of the body 15 of the baffle 14 distributed over the area of the foldable flaps 18, 20, the final assembled configuration of the baffle tile 10 shown in FIG. 1 should be stable under most conditions, and a tight fit between the slot 16 and the body 15 of the baffle 14 should prevent one from shifting with respect to the other.

Although the baffle tile 10 does not require adhesives or fasteners to remain in a stable, final configuration for installation and use, that does not preclude the use of adhesives or fasteners, particularly in special circumstances. For example, adhesives or fasteners could be used if required by local building regulations, or if the baffle tile 10 is to be installed at an angle, instead of resting on a horizontally-extending grid. Screws, staples, or other such mechanical fasteners could be applied between the foldable flaps 18, 20 and the tile 12. Adhesives could also be applied between the foldable flaps 18, 20 and the upper surface of the tile 12. Alternatively, pressure-sensitive adhesive may be pre-applied in those locations, with release layers protecting the applied adhesive until it is needed.

Figure 7:
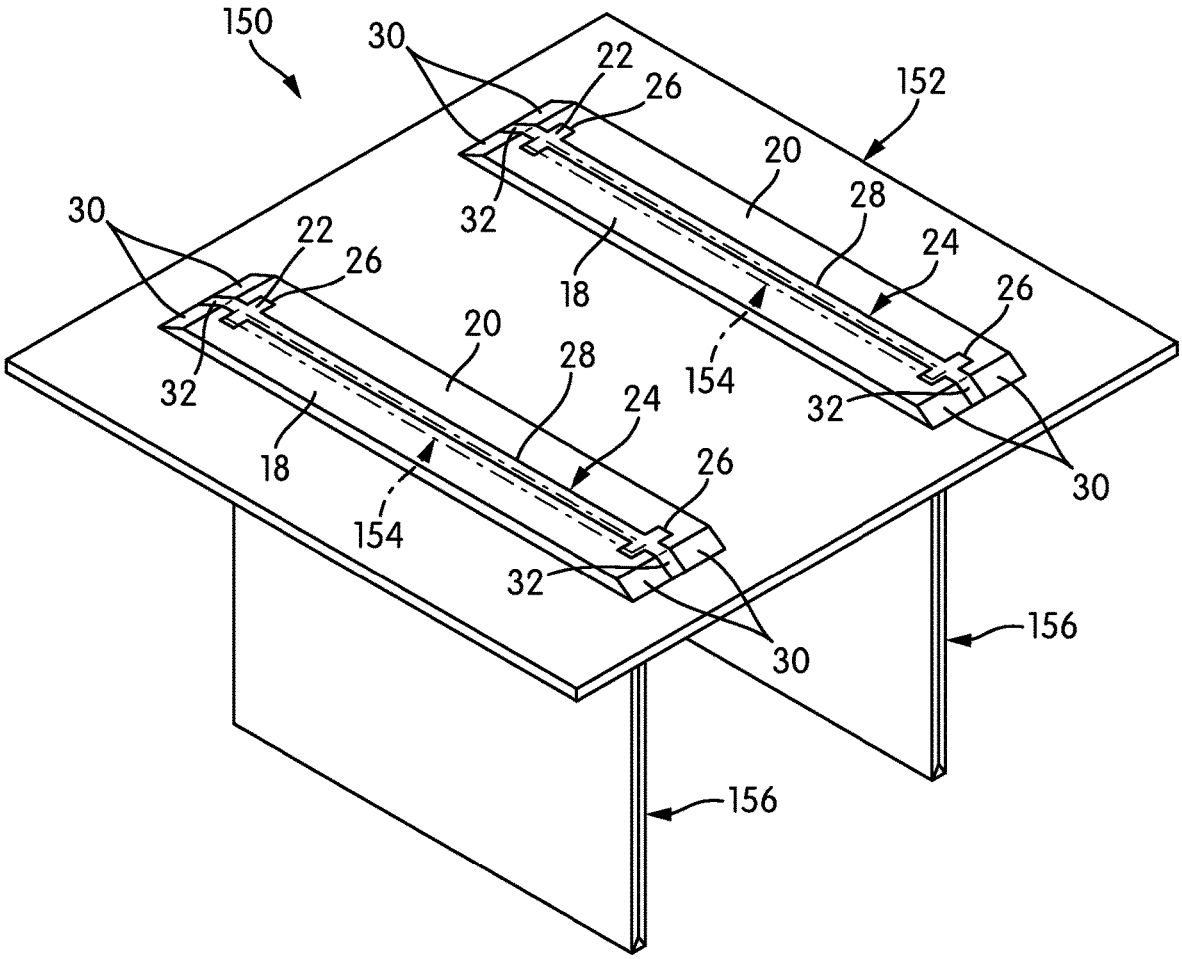
FIG. 7 is a perspective view of a baffle tile that includes two baffles.
Figure 8:
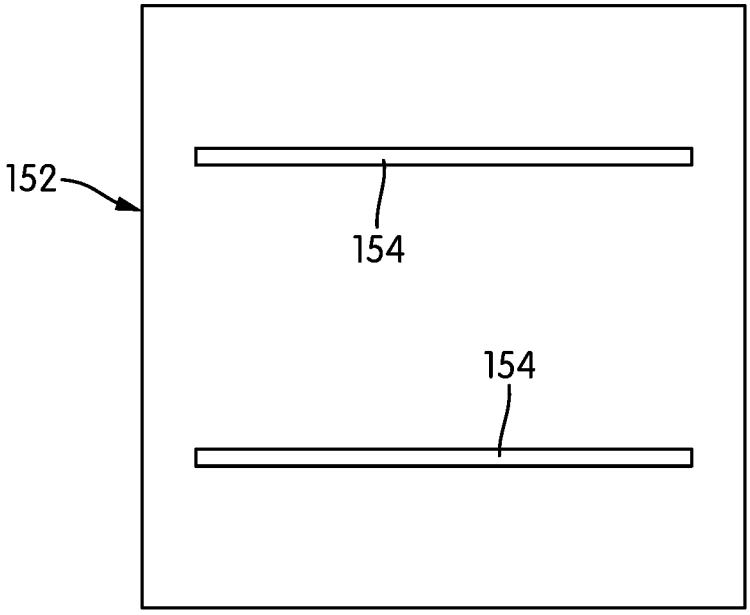
FIG. 8 is a top plan view of the baffle tile of FIG. 7.
Figure 9:
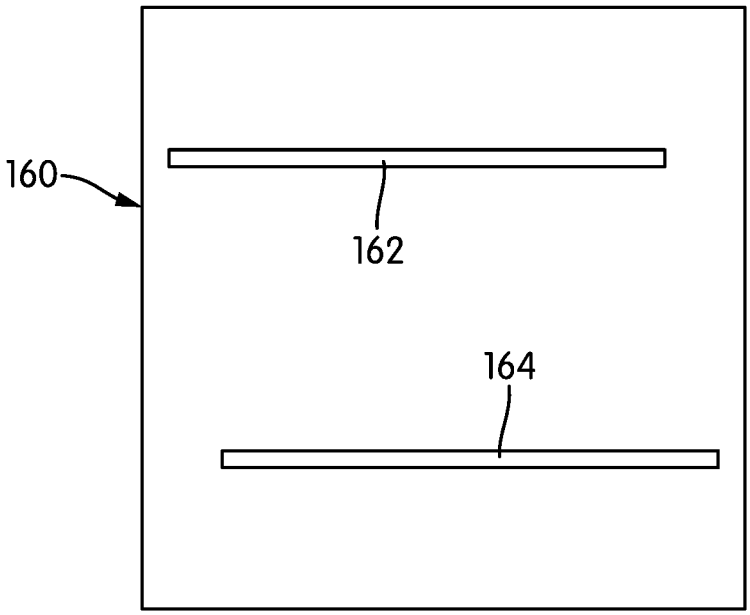
FIGS. 9-12 are top plan view of baffle tiles according to other embodiments of the invention, illustrating various alternative placements of slots and baffles.

FIG. 7 is a perspective view of a baffle tile 150 that includes a tile 152 with two slots 154 and two baffles 156 inserted into the slots 154. Each of the two baffles 156 has the same features as the baffle 14 described above. FIG. 8 is a top plan view of the tile 152 in isolation. As shown, the slots 154 are the same size, and are aligned with one another on either side of the centerline of the tile 152.

There are no particular limitations on the number of slots 154 that may be placed in any one tile 152, although the slots 154 should not be so numerous that the tile 152 loses its mechanical integrity. The spacing of the slots 154 is also not critical, although the slots 154 will generally be placed far enough apart that the foldable flaps 18, 20 of adjacent baffles 14, 156 can each independently lie flat against the surface of the tile 152.

In the baffle tile 10, the slot 16 is centered on the tile 12. In the baffle tile 150 of FIGS. 7-8, the slots 154 are aligned with one another, symmetrically offset from the centerline of the tile 152. These are not the only ways that slots may be arranged in a baffle tile.

FIGS. 9-12 are all top plan views of various tiles, illustrating different arrangements for slots. In the tile 160 of FIG. 10, there are two slots 162, 164 arranged vertically equidistant from the horizontal centerline of the tile 160. However, they are offset from one another along the width of the tile 160. (Here, terms like "vertical" and "horizontal" are given with respect to the coordinate system of the figures.)

Figure 10:
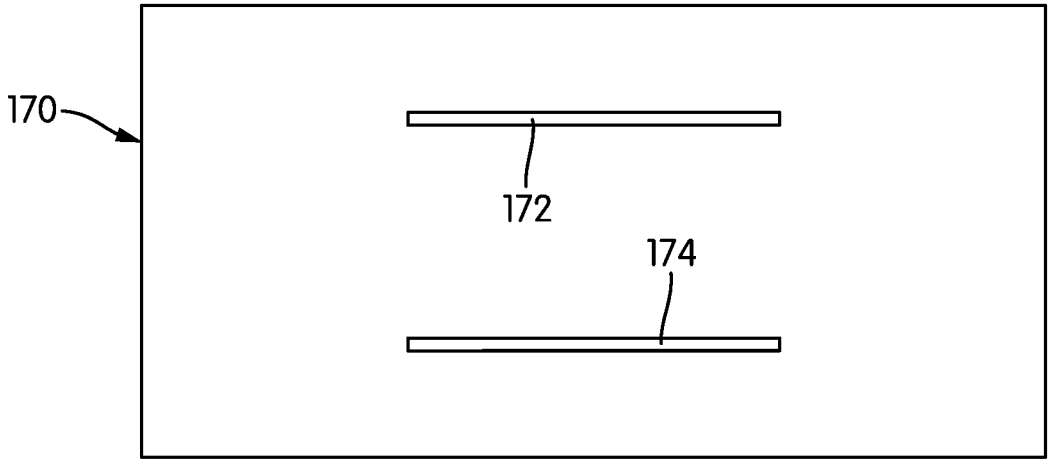

FIG. 10 is a top plan view of a rectangular tile 170. This tile 170 may be, e.g., a two-foot by four-foot standard ceiling tile. There are again two slots 172, 174, again horizontally aligned and symmetrically vertically offset from the horizontal centerline of the tile. As may be appreciated from the figures, the slots 172, 174 have the same width and accept the same baffles 14, 156 as the square tiles 12, 152, 160 described above. However, that need not be the case in all embodiments. A larger or differently-dimensioned tile like the tile 170 of FIG. 10 may have different-size slots and take different-size baffles.

Figure 11:
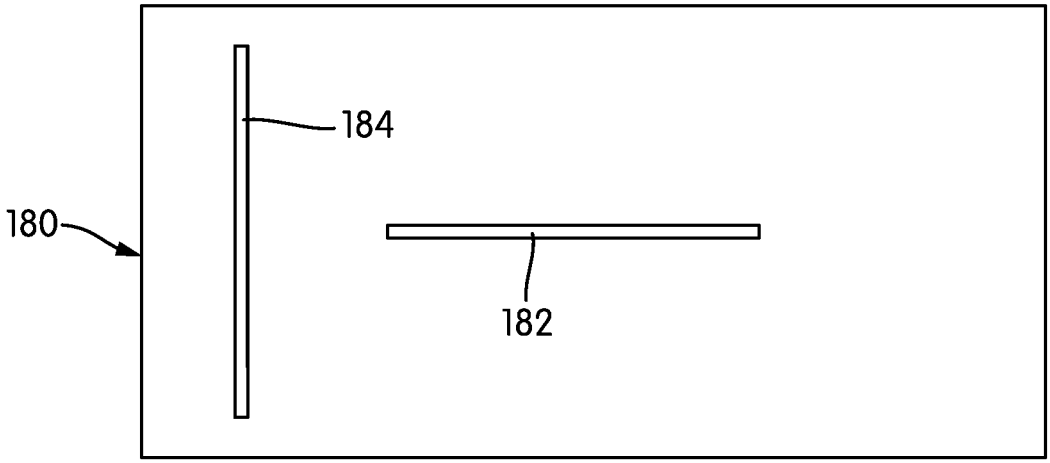

Because rectangular tiles like the tile 170 are wider, there are potentially more options for placement of slots and baffles. FIG. 11 is one example in which a tile 180 also has two slots 182, 184. In this case, one slot 182 is cut along the horizontal centerline of the tile 180. The other slot 184 is oriented vertically, 90° offset from the first slot 182 and is positioned at one end of the tile 180. In this case, both slots 182, 184 are the same length, but that need not always be the case. In some cases, a third slot may be positioned on the other side of the tile 180, so as to be symmetrical with the slot 184.

Figure 12:
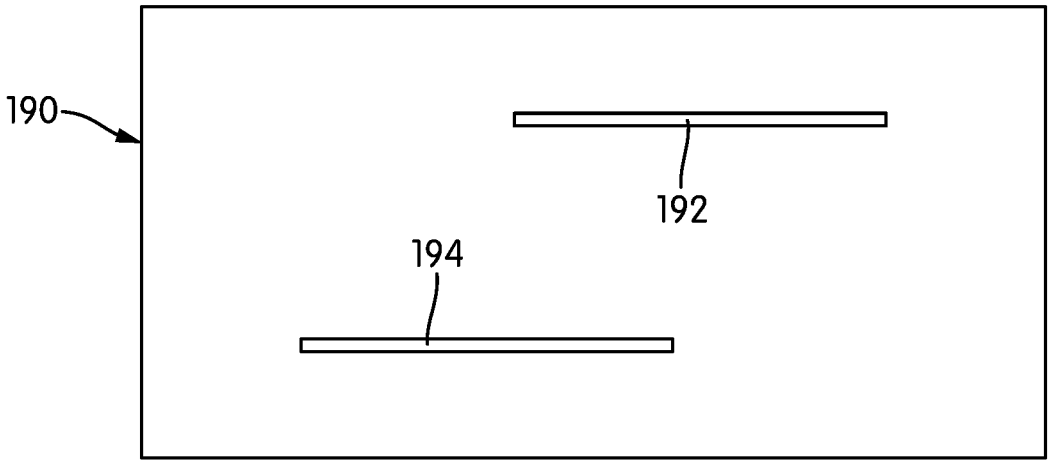

In the tile 190 of FIG. 12, the two slots 192, 194 are positioned vertically equidistant from the horizontal centerline of the tile 190. However, they are offset from each other horizontally such that the inner edge of each slot intersects with the vertical centerline of the tile 190. Of course, many other arrangements are possible.

In all of the embodiments illustrated in FIGS. 1-12, the baffle 14 comprises two sections of tile material folded directly against each other. Other types of baffles may be made in accordance with embodiments of the invention.

Figure 13:
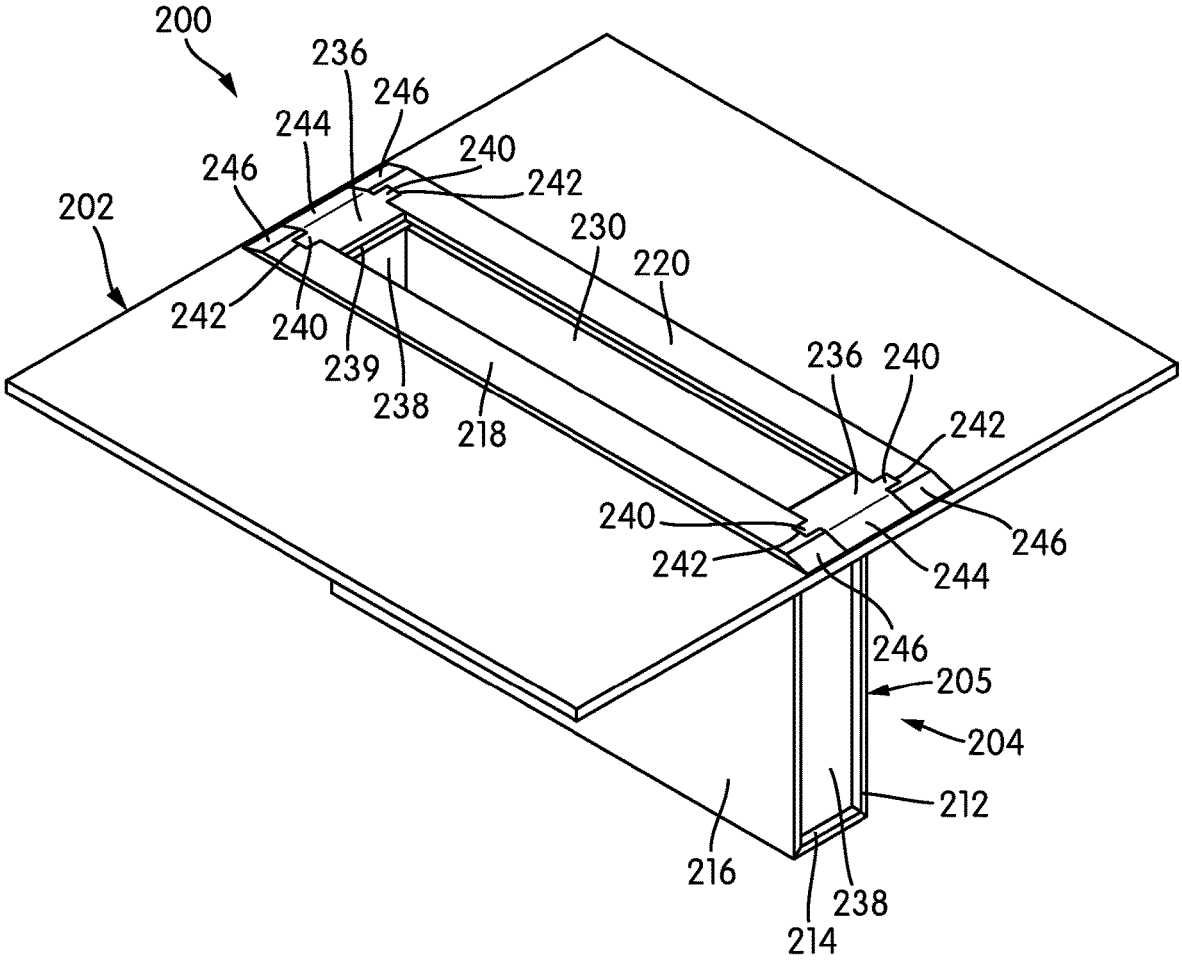
FIG. 13 is a perspective view of a baffle tile with a broadened baffle according to yet another embodiment of the invention, shown in a fully assembled configuration.

FIG. 13 is a perspective view of a baffle tile, generally indicated at 200, according to another embodiment of the invention. As with previous embodiments, the baffle tile 200 includes a tile 202 and a baffle 204. In this embodiment, though, the downwardly-extending body 205 of the baffle 204 has a broadened rectilinear shape with an internal volume, and the slot 206 in the tile 202 (obstructed from view in FIG. 13) is commensurately wider to accommodate the broader body 205. The use of a broader body 205, like that illustrated in FIG. 13, may have acoustic benefit. In some cases, the interior volume may be stuffed with additional sound-absorptive material or used to house building elements, like pipes, tubes, ducts, sprinklers, etc.

As with other embodiments in this description, the baffle tile 200 and its parts 202, 204 are designed to be made and shipped flat, usually for final assembly on site just prior to installation. They are typically also of sizes that allow them to be cut out of a standard sheet of tile material, e.g., a two-foot by four-foot sheet of PET felt, although that need not always be the case.

Figure 14:
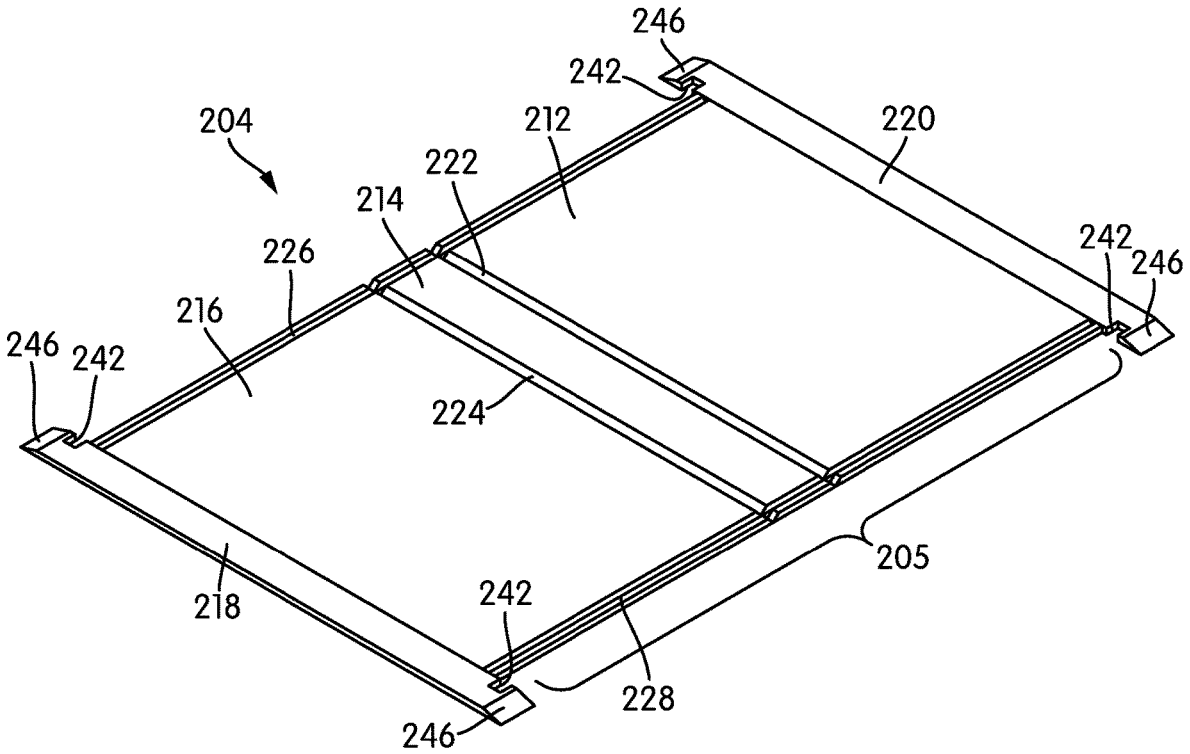
FIG. 14 is a perspective view illustrating the baffle of the baffle tile of FIG. 13 in isolation, shown in an initial, unfolded configuration.
Figure 15:
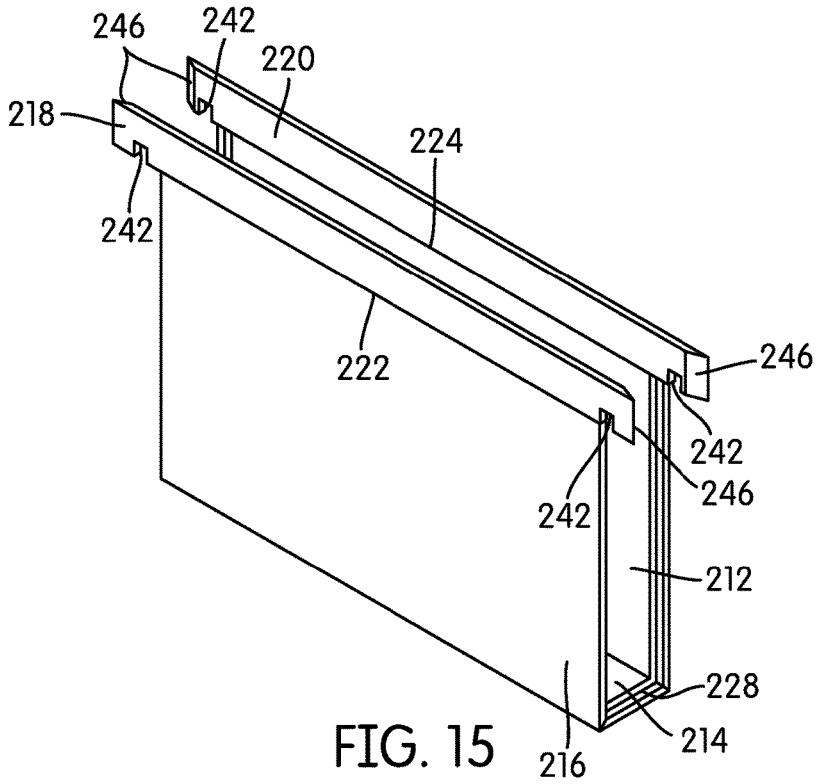
FIG. 15 is a perspective view illustrating the baffle of FIG. 14 in a folded configuration, prepared for installation in the tile.

FIG. 14 is a perspective view of the baffle 204 in isolation, shown in its flat, unassembled configuration. Two fold lines 208, 210 are cut into the material on either side of the transverse centerline of the baffle 204, creating a body with three connected sections 212, 214, 216. The two larger sections 212, 216 have equal size, are mirror images of one another, and serve as the downwardly-extending sides of the body 205 when the baffle 204 is in the installed configuration of FIG. 15, another perspective view. The fold lines 208, 210, like some of the other fold lines described here, are V-cuts in the material in this embodiment. The two fold lines 208, 210 allow the baffle 204 to fold into the generally U-shaped configuration illustrated in FIG. 15.

At the outer (upper) transverse ends, the two larger sections 212, 216 have flaps 218, 220, which are separated from their respective sections 212, 216 by fold lines 222, 224. The flaps 218, 220 have essentially the same features as the flaps 18, 20 described above, e.g., they are broader in at least one dimension than the slot 206 in the tile, and thus, will prevent the baffle 204 from falling through the slot 206. Yet while the flaps 218, 220 may have the same basic purpose and features of the flaps 18, 20 described above, differences in the size and proportions of the slot 206 may require the flaps 218, 220 to have significantly different proportions or dimensions than the flaps 18, 20 described above.

In addition to the features described above, the body 205 has a pair of grooves 226, 228 that run longitudinally and continuously along all three sections 212, 214, 216 and also extend continuously over the fold lines 222, 224 that separate the three sections 212, 214, 216. The grooves 226, 228 are inset a short distance from the lateral edges of the body 205. The purpose of the grooves 226, 228 will be described below in more detail.

Figure 16:
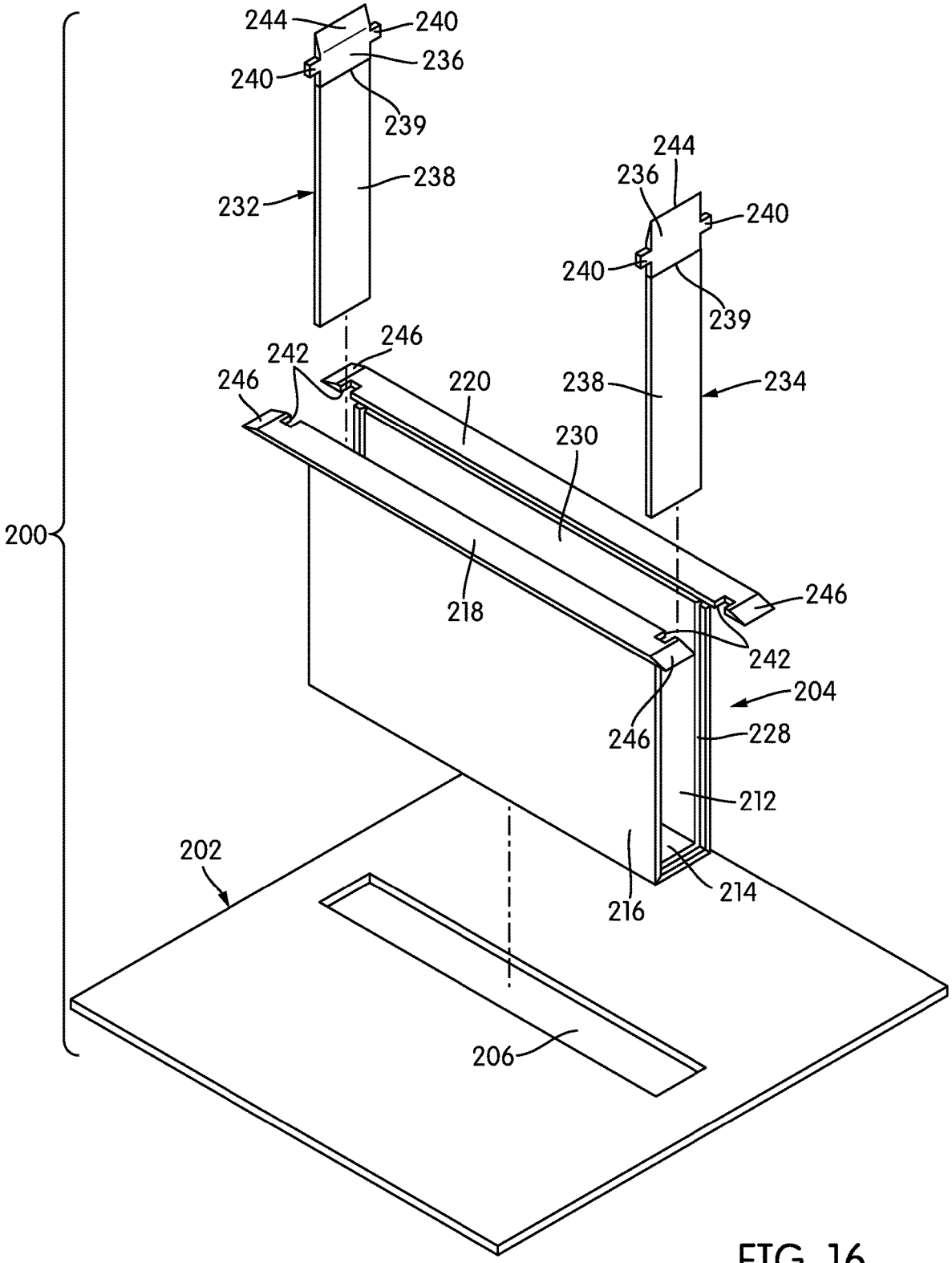
FIG. 16 is an exploded perspective view of the baffle tile of FIG. 13, illustrating its assembly.

FIG. 16 is an exploded perspective view illustrating the first steps in assembling the baffle tile 200. All of the components of the baffle tile 200 are shown in FIG. 16, including the tile 202, the baffle 204, and a pair of locking-closing members 230, 232. The enlarged slot 206 in the tile 202 is visible in FIG. 16. The baffle 204 is shown folded into the generally U-shaped configuration of FIG. 15, with the two larger sections 214, 216 serving as sidewalls and the smaller section 214 between them serving as a bottom. In the view of FIG. 16, the flaps 218, 220 are folded down, perpendicular to the vertical extent of the two vertical sections 212, 216 and parallel with the extent of the tile 202.

As with the flaps 18, 20 described above, the flaps 218, 220 define a slot 230 between them. The slot 230 accommodates structures that lock the baffle 204 in place. However, because the baffle 204 is configured differently from the embodiments described above, the locking structures are different. Specifically, the baffle tile 200 uses two locking members 232, 234, both of which are shown in FIG. 16, exploded away from the baffle 204. Each locking member 232, 234 is typically made of the same material, and the same thickness of material, as the other components of the baffle tile 200, although different materials may be used in some embodiments. Each locking member 232, 234 includes two segments, an upper segment 236 and a lower segment 238.

The upper segments 236 serve the purpose that the locking member 22 does in the embodiments described above. Specifically, each of the upper segments 236 is complementary in shape to the shape of the slot 230, in particular having projections 240 that are complementary in shape to features 242 cut into the inner edges of the flaps 218, 220. In this embodiment, the upper segments 236 also have a beveled edge 244 that matches the corresponding beveled edges 246 of the flaps 218, 220.

The lower segments 238, by contrast, have a purely rectilinear shape. Each upper segment 236 is separated from its respective lower segment 238 by a fold line 239 that is cut into the material.

Figure 17:
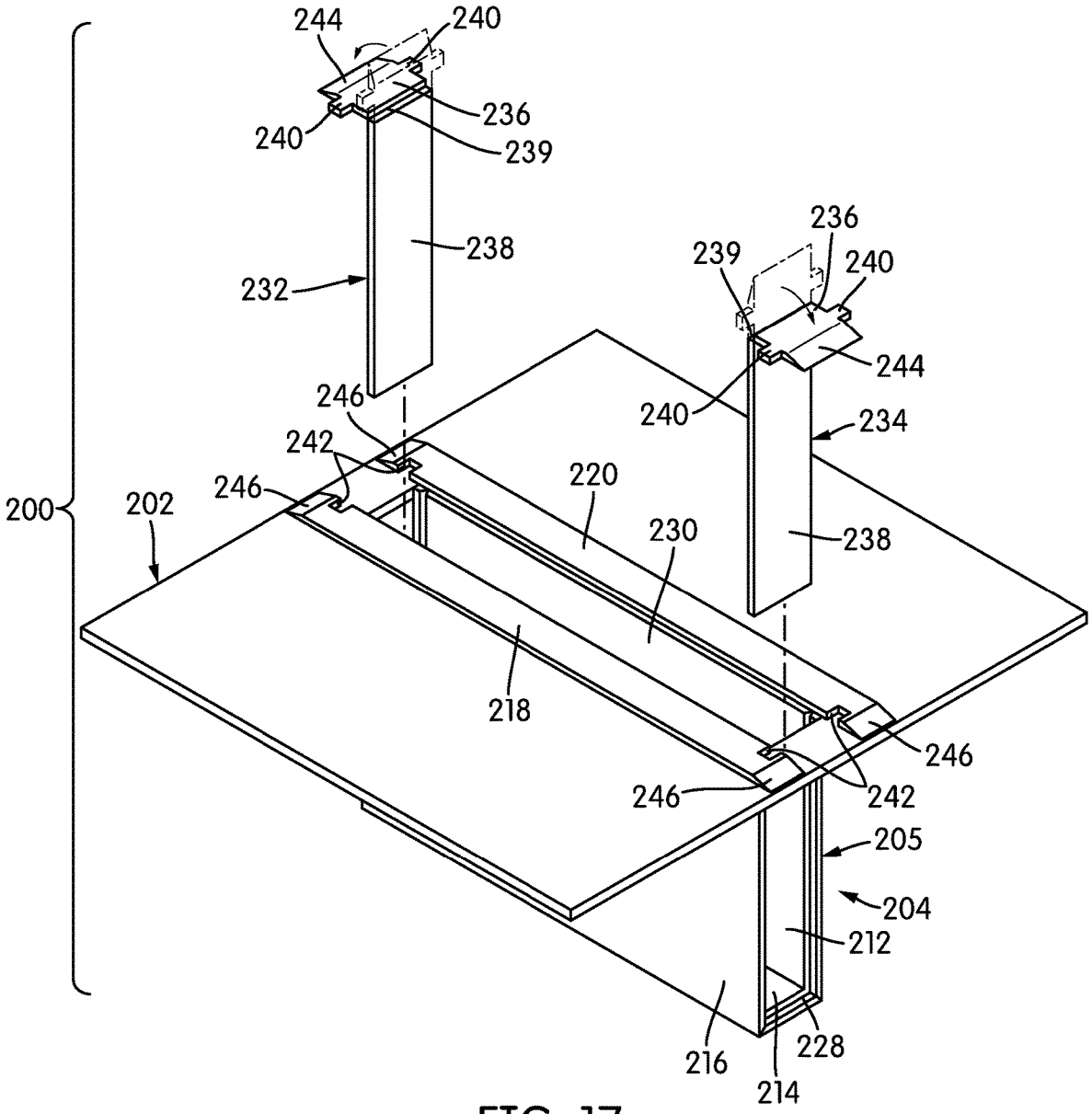
FIG. 17 is a partially exploded perspective view of the baffle tile of FIG. 13, illustrating the installation of locking-closing members as a final step in assembly.

FIG. 17 is another exploded perspective view that illustrates the next step in the assembly of the baffle tile 200. In the view of FIG. 17, the baffle 204 has been inserted into the slot 206 in the tile 202, and the flaps 218, 220 rest against the tile 202, extending horizontally along the tile 202, beyond the slot 206.

As shown in FIG. 17, during assembly, the upper segments 236 of the locking members 232, 234 are bent at their fold lines 239, such that each upper segment 236 extends at a 90° angle to its lower segment 238. The upper segments 236 are pressed into opposite sides of the slot 230, aligned with the respective lateral ends of the slot 230. The lower segments 238 extend downwardly and are slid into the grooves 226, 228 cut into the sides of the body 205. Thus, the upper segments 236 of the locking members 232, 234 lock the baffle 204 in place, while their lower segments 238 close the sides of the body 205. Closing the sides of the body 205 has aesthetic benefits, and may also provide a measure of dimensional stability, helping to maintain the shape of the body 205 and the baffle 204 as a whole.

Figure 18:
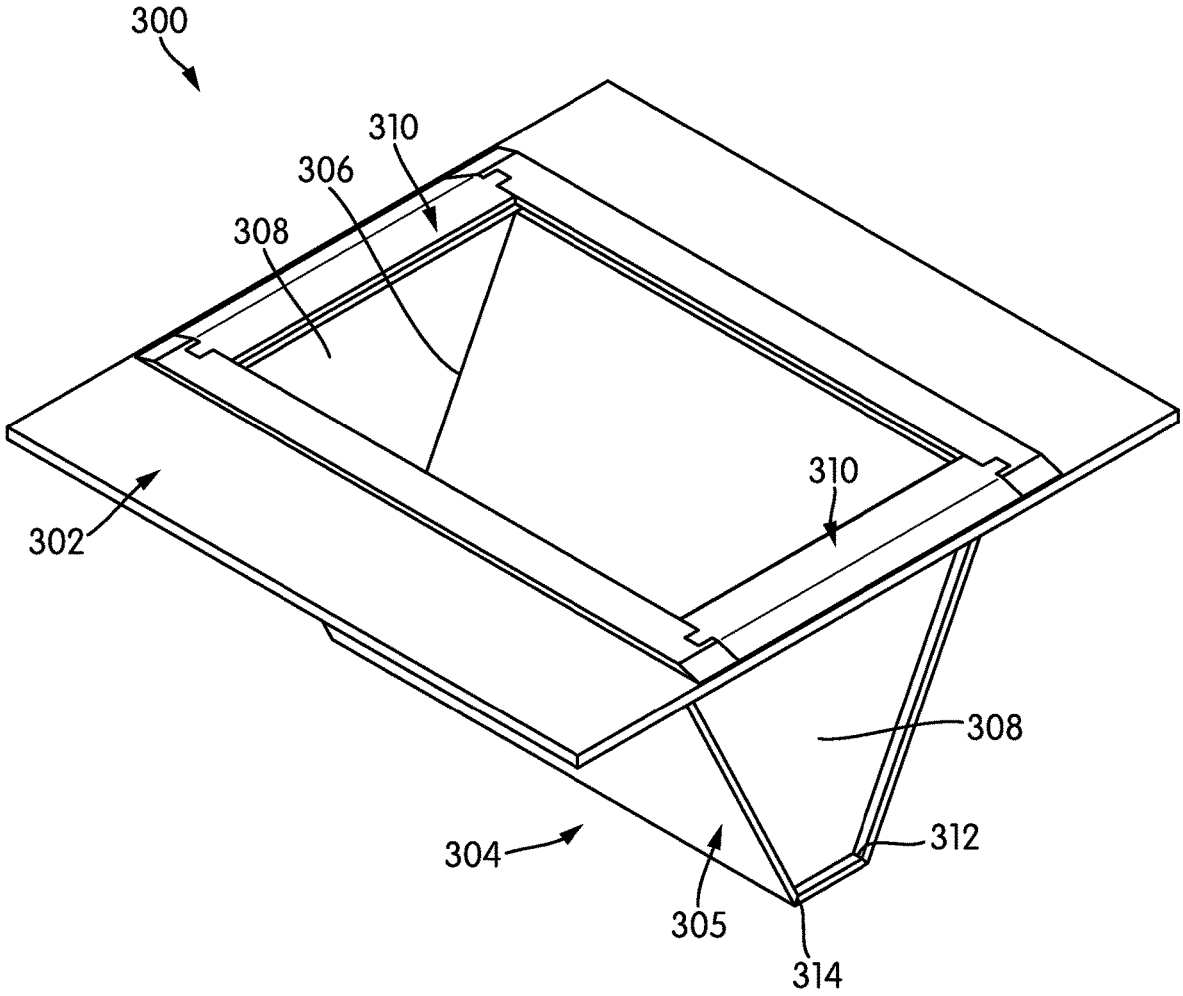
FIG. 18 is a perspective view of a baffle tile with a trapezoidally-shaped baffle according to yet another embodiment of the invention.

In the description above, the baffle or baffles 14, 204 are rectangular or rectangular prisms. However, the baffle of a baffle tile may have a variety of shapes. As one additional example, FIG. 18 is a perspective view of a baffle tile, generally indicated at 300. As with the other embodiments, the baffle tile 300 has tile 302 and a baffle 304. In this embodiment, in its assembled configuration, the baffle 304 has the shape of a trapezoidal prism. Because of the relative dimensions of the body 305 of the baffle 304, the tile has a large opening 306 and the proportions of the other components are somewhat different as well. For example, the lower segments 308 of the locking members 310 have a trapezoidal shape. The two fold lines 312, 314 may be cut slightly differently to accommodate the different joint angles of the trapezoidal prism. Otherwise, save for proportions, the features of the baffle tile 300 are substantially similar to those of the baffle tile 200 described above.

Figure 19:
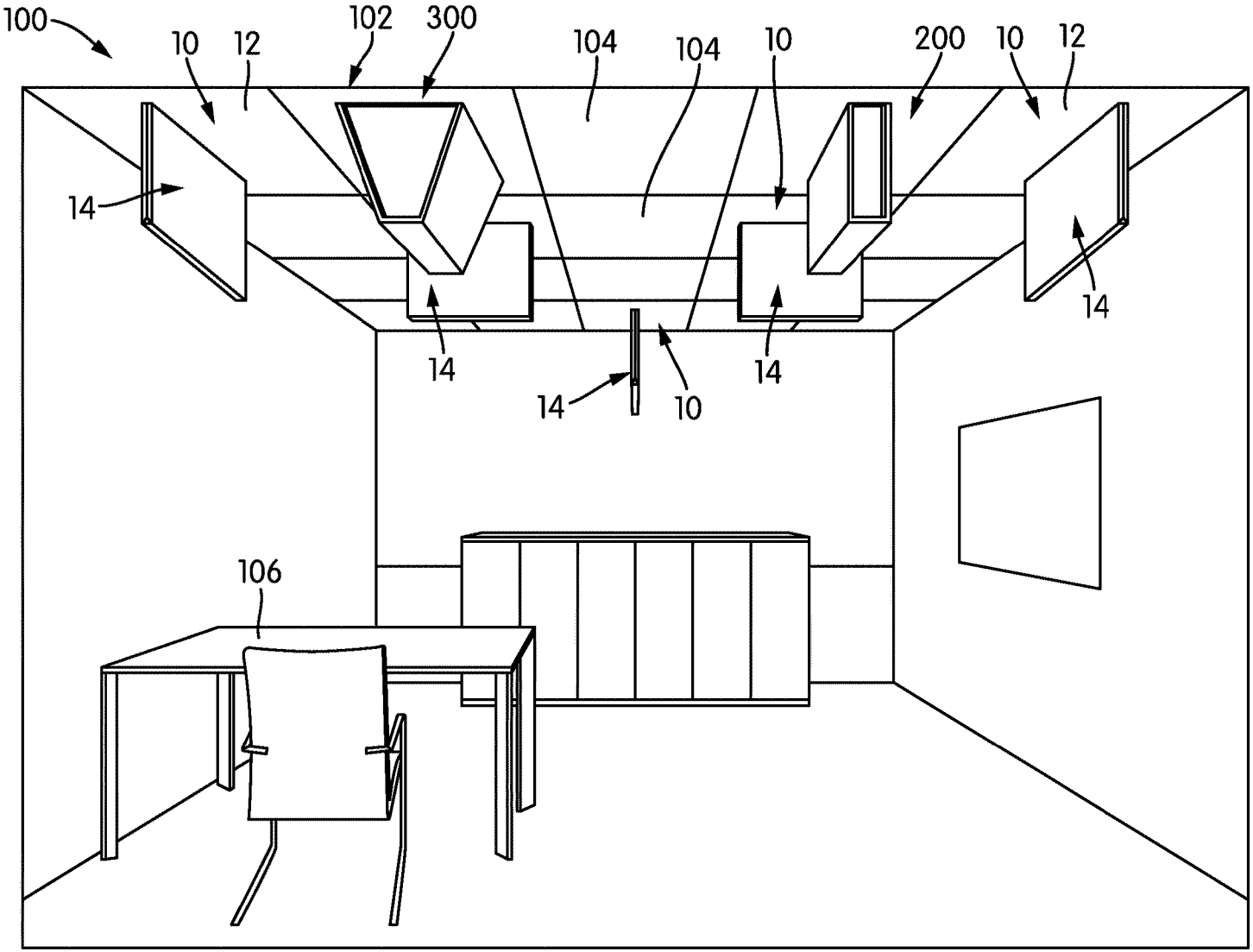
FIG. 19 is a perspective view of a room that uses a drop ceiling with various types of baffle tiles.

FIG. 19 is a perspective view of a room, generally indicated at 100. The room 100 has a drop ceiling grid 102. Installed in the drop ceiling grid 102 are a number of typical ceiling tiles 104, and a number of baffle tiles 10, 200, 300 of various types. Because the tiles 12, 202, 302 are typically made to standard dimensions of width and depth, they can be placed in a standard drop ceiling grid 102. The baffle tiles 10, 200, 300 can be installed where it is decided that their use will have the most impact. They may be installed in some relationship with the furniture 106 in the room, e.g., to isolate one workstation from adjacent ones, or in high-traffic areas that are likely to be noisy. Several baffle tiles 10, 200, 300 may be placed adjacent to one another to form a continuous or nearly continuous row of baffles 14, 204, 304, or baffle tiles 10, 200, 300 may be interspersed with typical ceiling tiles 104, as is the case in FIG. 19. A drop ceiling grid 102 may include any combination of typical ceiling tiles 104, baffle tiles 10, 200, 300 and the baffle tiles disclosed in U.S. Pat. Nos. 10,975,568 and 11,174,635, both of which are incorporated herein in their entireties. Moreover, as was noted above, in some cases, the baffle 14, 204, 304 need not be made of the same material as the tile 12, 202, 302, and in some cases, the material of the baffle 14, 204, 304 may influence its placement. For example, if a baffle material is more absorptive or dissipative of acoustical energy at certain frequencies, a baffle 14, 204, 304 made of that material may be placed in a location where those frequencies are found or are prevalent.

The placement of baffle tiles 10, 200, 300 need not be entirely dictated by functional considerations. In many cases, baffle tiles 10, 200, 300 may be placed for aesthetic as well as functional reasons.

In the description above, the parts of the baffle tiles 10, 200, 300 are typically made of the same type of material. While this need not be the case in all embodiments, even if the parts of baffle tiles 10, 200, 300 are made of the same type of material, they may be made of materials that have different colors, textures, or other aesthetic properties.

While the invention has been described with respect to certain embodiments, the description is intended to be exemplary, rather than limiting. Modifications and changes may be made within the scope of the invention, which is defined by the appended claims.

What is claimed is:

1. A ceiling tile, comprising:

a tile having an upper face and a lower face arranged such that a thickness of the tile is defined therebetween, a baffle slot extending through the thickness of the tile, the baffle slot being positioned and dimensioned within the tile such that the baffle slot is closed on all sides;

a baffle having a body sized and adapted to insert through the baffle slot in the tile, such that, in an operational position of the ceiling tile, a lower portion of the baffle extends through the baffle slot and is adjacent to the lower face of the tile while an upper portion of the baffle remains adjacent to the upper face, a pair of flaps contiguous with the body and defined in the upper portion of the baffle by fold lines that allow the pair of flaps to fold outwardly, relative to and away from the body, and a locking slot defined by or in the pair of flaps such that the locking slot is operationally useable when the pair of flaps is folded outwardly to the extent that each of the pair of flaps extends generally in the same plane as the other, with each of the pair of flaps extending away from the other; and a locking member configured and sized to fit within the locking slot when the locking slot is operationally useable.

2. The ceiling tile of claim 1, wherein the baffle comprises a flat sheet of material with one or more body fold lines that fold to define the body of the baffle.

3. The ceiling tile of claim 2, wherein the body of the baffle comprises two sections of tile material folded against one another.

4. The ceiling tile of claim 3, wherein the one or more body fold lines comprise a central fold line about which the two sections of tile material fold against one another.

5. The ceiling tile of claim 1, wherein the locking slot is defined by and along respective opposed proximal edges of the pair of flaps.

6. The ceiling tile of claim 5, wherein the pair of flaps includes cut-out portions that form a part of the locking slot.

7. The ceiling tile of claim 6, wherein the locking member includes one or more alignment features.

8. The ceiling tile of claim 7, wherein the cut-out portions have a shape complementary to the alignment features.

9. The ceiling tile of claim 1, wherein the tile, the baffle, and the locking member are made of a tile material.

10. The ceiling tile of claim 9, wherein the tile material comprises a polyethylene terephthalate (PET) felt.

11. The ceiling tile of claim 1, further comprising a second baffle slot extending through the thickness of the tile, the second baffle slot being spaced from the first baffle slot.

12. The ceiling tile of claim 11, further comprising a second baffle including:

a baffle body sized and adapted to insert through the second baffle slot in the tile, a pair of flaps defined by fold lines that allow the pair of flaps to fold outwardly, relative to and away from the body, and a locking slot defined by or in the pair of flaps.

13. The ceiling tile of claim 12, further comprising a second locking member sized to fit within the locking slot of the second baffle.

14. The ceiling tile of claim 1, wherein the body of the baffle includes a first portion and a second portion that fold relative to one another, defining a pair of opposed open sides.

15. The ceiling tile of claim 14, further comprising a second locking member, the locking member and the second locking member including:

a first portion having a shape complementary to the locking slot;

a second portion shaped and configured to close one of the pair of opposed open sides; and a fold line defined between and separating the first portion and the second portion.

16. The ceiling tile of claim 15, wherein the body of the baffle includes a third portion interposed between the first portion and the second portion with fold lines defined therebetween, such that the body of the baffle is adapted to fold such that the first portion and the second portion form sides and the third portion forms a bottom.

17. The ceiling tile of claim 15, further comprising a first groove extending continuously over the body of the baffle along one side proximate to an edge, and a second groove extending continuously over the body of the baffle along a second side, proximate to another edge, the first groove and the second groove adapted to receive the second portion of the locking member and the second portion of the second locking member.

18. A method of assembling a ceiling tile:

inserting a body of a baffle through a slot in a tile, the slot extending through a thickness of the tile;

folding a pair of flaps defined by fold lines at an upper extent of the body of the baffle outwardly, away from the body and down, such that each of the pair of flaps rests with a lower surface abutting an upper surface of the tile, said folding exposing and placing in an operational configuration a locking slot defined in, between, or in and between respective ones of the pair of flaps when each of the pair of flaps rests with the lower surface abutting the upper surface of the tile; and inserting a locking member into the locking slot.

19. The method of assembling a ceiling tile of claim 18, wherein the locking slot is defined between proximal edges of the respective ones of the pair of flaps, with at least a portion of the locking slot cut into each of the pair of flaps.

20. The method of assembling a ceiling tile of claim 19, wherein the locking member includes portions that are complementary to the portions of the locking slot that are cut into each of the pair of flaps.

21. The method of assembling a ceiling tile of claim 18, further comprising folding a portion of the locking member downwardly to close an open side of the body of the baffle.

* * * * *